United States Patent [19]

White et al.

[11] 4,030,842

[45] June 21, 1977

[54] COMBINATION WRITING INSTRUMENT AND INFORMATION STORAGE APPARATUS

[76] Inventors: John White; David Abbots, both of Alexander Drive, Brookfield, Conn. 06804

[22] Filed: Aug. 3, 1976

[21] Appl. No.: 711,120

[52] U.S. Cl. ..... 401/195; 242/55; 242/53; 40/335

[51] Int. Cl.[2] ..... B43K 29/00

[58] Field of Search ..... 401/195, 52; 40/334, 40/335; 242/55, 53; 281/6–11

[56] References Cited

UNITED STATES PATENTS

| | | | |
|---|---|---|---|
| 2,111,362 | 3/1938 | Fisher | 40/335 |
| 3,552,869 | 1/1971 | Johnson | 401/195 |
| 3,963,358 | 6/1976 | Houser | 401/195 |

FOREIGN PATENTS OR APPLICATIONS

| | | | |
|---|---|---|---|
| 1,043,580 | 6/1953 | France | 401/195 |

*Primary Examiner*—Lawrence Charles
*Attorney, Agent, or Firm*—Robert D. Farkas

[57] ABSTRACT

A combination writing instrument and information storage apparatus including an elongated barrel, an elongated tubular spindle dimensioned to be partially inserted in a first longitudinal chamber provided by the elongated barrel, the tubular spindle providing a third longitudinal chamber therein, means for rotatably securing the elongated tubular spindle within the elongated barrel, an elongated cap element having a second longitudinal chamber therein, means for securing the elongated tubular spindle to the elongated cap element, cartridge type writing means adapted to reside within the coextensive first, second, and third longitudinal chambers, means for extending and retracting the writing means from the elongated barrel, and a flexible sheet fixedly secured to the outer surface of the spindle and extending outwardly through a longitudinal slot provided in the elongated barrel, rotation of the spindle retracting and extending the flexible sheet.

10 Claims, 3 Drawing Figures

COMBINATION WRITING INSTRUMENT AND INFORMATION STORAGE APPARATUS

BACKGROUND OF THE INVENTION

1. Field of the Invention

The present invention relates to writing instruments having extensible quantities of paper or the like stored therein, and more particularly, to a combination writing instrument and information storage apparatus.

2. Description of the Prior Art

The prior art bounds with writing apparatuses designed to retain and selectively extend a quantity of paper or the like. Unfortunately, the extension of the paper or the like affects the writing ability of these apparatuses. Also, they are complex in design, expensive to manufacture, and frequently, the paper dispensing mechanism severly limits the quantity of ink, or the like retained within the instrument.

U.S. Pat. No. 640,543 issued to F. W. Donning on Jan. 2, 1900 disclosed a combined paper holder and pencil which includes a roll of paper disposed around and supported by a mandrel disposed within a housing. As the mandrel is rotated by a plug handle fixedly secured on one end thereof, the pencil point tube adjacent to the mandrel is subject to unwanted rotation. This severely affects the reliability of the writing instrument.

U.S. Pat. No. 2,224,470 issued to W. H. Boust on Dec. 10, 1940 teaches a memorandum pencil having a roll of paper disposed around a rotatable shaft within a tubular casing. As the shaft is rotated the paper is dispensed. In the primary embodiment of this invention the size of the pencil element thereof is severely limited. In the secondary embodiment the pencil mechanism rotates as the paper is dispensed.

The present invention overcomes the problems associated with the prior art by providing a combination writing instrument and information storage apparatus which dispenses and retracts a flexible sheet without impeding the size of the writing instrument portion or the writing ability thereof.

SUMMARY OF THE INVENTION

Therefore, a primary object of the present invention is to provide a combination writing instrument and information storage apparatus wherein the flexible sheet dispensed thereby does not impede the size of the writing instrument portion thereof.

A further object is to provide a combination writing instrument and information storage apparatus which may extend and retract the flexible sheet thereof without interfering with the writing ability of the instrument.

Still another object is to provide a combination writing instrument and information storage apparatus which quickly and simply retracts and extends the flexible sheet thereof.

A still further object is to provide a combination writing instrument and information storage apparatus wherein the writing instrument portion may be interchanged quickly and simply.

Another object is to provide a combination writing instrument and information storage apparatus which is compatible with lead, ball point, and soft tip writing instrument portions.

Still another object is to provide a combination writing instrument and information storage apparatus which is simple in design, inexpensive to manufacture, and durable.

These objects, as well as further objects and advantages, of the present invention will become readily apparent after reading the description of a non-limiting illustrative embodiment and the accompanying drawing.

According to the principles of the present invention a combination writing instrument and information storage apparatus includes an elongated barrel having first and second free ends and a first longitudinal open-ended chamber therein, a longitudinal slot being located in an outer slot of the barrel and extending into the first chamber; an elongated cap element having a second longitudinal chamber therein, the cap element having a first free end and a second free end; an elongated tubular spindle dimensioned to be partially inserted through the second free end of the barrel and within the first longitudinal chamber, the spindle having a third longitudinal open-ended chamber therein, the spindle having a first free end and a second free end; means for securing the first free end of the elongated tubular spindle to the second free end of the elongated cap element, the second and the third longitudinal chambers being partially coextensive; rotatable securing means for rotatably securing the elongated tubular spindle partially within the barrel, the first and the second longitudinal chambers being partially coextensive; cartridge-type writing means dimensioned to reside within the first, the second, and the third longitudinal chambers when the barrel is rotatably affixed to the spindle and the spindle is fixedly secured to the cap element; means for extending and retracting the writing means through the first free end of the barrel; and a flexible sheet fixedly secured on one end thereof to the outer surface of the spindle and extending outwardly through the longitudinal slot, the rotation of the spindle in one direction about the longitudinal axis thereof retracting the flexible sheet within the first longitudinal chamber of the barrel, the rotation of the spindle in the other direction about the longitudinal axis thereof extending the flexible sheet out of the slot.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
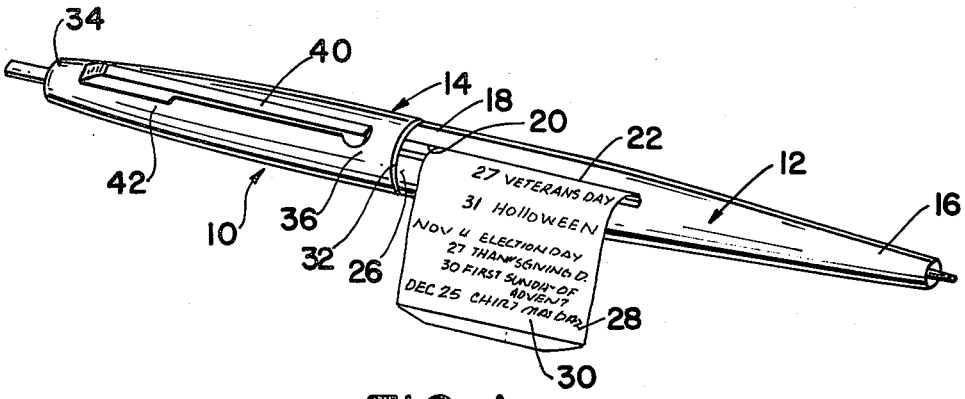
FIG. 1 is a perspective view of the preferred embodiment incorporating the principles of the present invention.

Referring now to the FIGS, and more particularly to FIG. 1, there is illustrated therein a combination writing instrument and information storage apparatus 10 which includes an elongated barrel 12 and an elongated cap element 14. The elongated barrel 12 has a first free end 16 and a second free end 18. A longitudinal slot 20 is located in the outer surface 2 of the barrel 12 and extends into a first longitudinal open-ended chamber 24 formed within the barrel 12 and shown in FIG. 2. The slot 20 is open ended and extends through the second free end 18 of the barrel 12 and the free edge 26 adjacent thereto. A flexible sheet 28 extends outwardly from the slot 20 and is provided with informational indicia 30 thereon. The informational indicia 30 is a list of selected dates and corresponding holidays but may also include a calendar or the like. The second free end 18 of the barrel 12 is rotatably secured to an elongated tubular spindle 32 as shown in FIG. 2.

Figure 2:
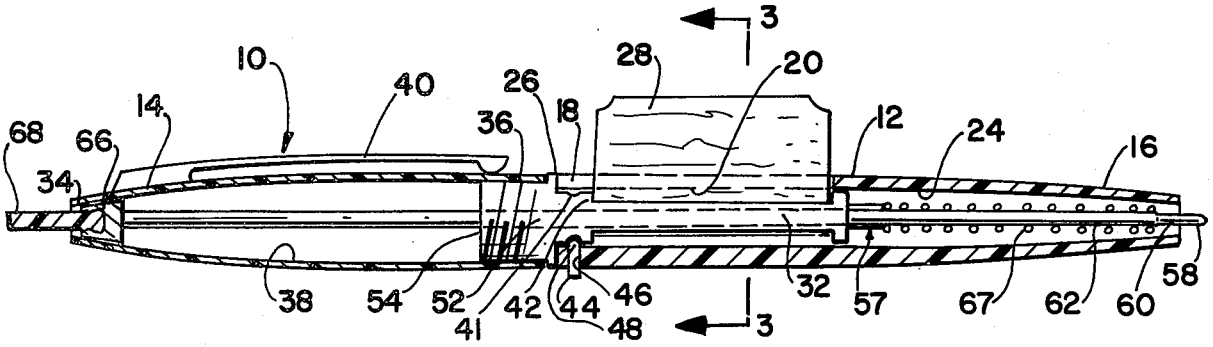
FIG. 2 is a side view of the preferred embodiment shown in cross section.

The elongated cap element 14 provides a first free end 34 and a second free end 36 and provides a second longitudinal chamber 38 therein as shown in FIG. 2. The second free end 36 of the elongated cap element 14 is secured to the spindle 32 as hereinafter described. A pocket clip 40 is fixedly secured to the outer surface 42 of the cap element 14.

FIG. 2 illustrates the spindle 32 partially inserted and rotatably secured within the first longitudinal open-ended chamber 24 of the elongated barrel 12. An annular groove 41 which is disposed in a plane substantially normal to the longitudinal axis of the spindle 32 is located in the surface 42 thereof. A pin 44 is frictionally disposed through an aperture 46 located through the barrel 12. The free end 48 of the pin 44 extending into the first chamber 24 is dimensioned to extend within the annular groove 41 and thereby rotatably retain the spindle 32 in position. The pin 44 permits the rotation of the spindle 32 about the longitudinal axis thereof. The spindle 32 provides a third open-ended chamber 50 therein as shown in FIG. 3.

The elongated cap element 14 is removably secured on the second free end 36 thereof to the first free end 52 of the spindle 32 by an externally threaded portion 54 provided adjacent to the first free end 52 of the spindle 32 and an internally threaded portion 56 provided adjacent the second free end 36 of the cap element 14. The internally threaded portion 56 is dimensioned to capture and threadably retain the externally threaded portion 54. Longitudinal rotation of the cap element 14 causes longitudinal rotation of the spindle 32 within the first chamber 24 of the barrel 12.

When the elongated barrel 12, the cap element 14 and the spindle 32 are assembled as previously described the first, second, and third longitudinal chambers 24, 38, and 50 are mutually coextensive. A ballpoint ink cartridge 57 including a ball applicator 58, a housing 60 therefore, and an elongated hollow ink reservoir 62 filled with ink operatably connected to the housing 60 is disposed through the firs, second, and third longitudinal chambers 24, 38, and 50. The housing 60 extends partially out of the first free end 16 of the barrel 12. The free end 64 of the ink reservoir 62 is in operable contact with a conventional rotatable inclined plane locking type extending and retracting mechanism 66 located at the first free end 34 of the cap element 14. The mechanism 66 works in cooperation with a helical compression spring 67 and provides a button 68 which extends outwardly from the free end 34 of the cap element 14 and activates and deactivates the mechanism 66.

Figure 3:
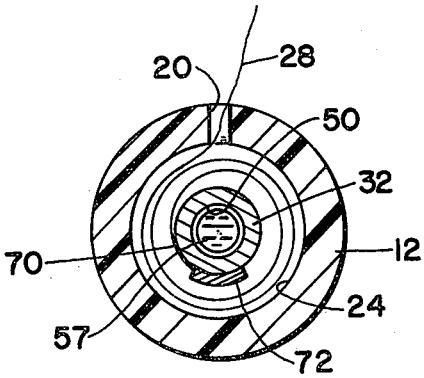
FIG. 3 is a cross sectional view of the preferred embodiment taken through the lines 3—3 of FIG. 2.

The flexible sheet 28 is fixed secured on one edge 70 thereof to the spindle 32 as shown in FIG. 3. When the spindle 32 is rotated in one direction about the longitudinal axis thereof, the sheet 28 is extended out of the barrel 12. When the spindle 32 is rotated in the opposite direction, the sheet 28 is wound around the spindle 32 and retracted into the barrel 12.

FIG. 3 illustrates the flexible sheet 28 fixedly secured on the free edge 70 thereof to the spindle 32 by a piece of adhesive tape 72. The flexible sheet is shwon partially extended out of the slot 20 provided in the barrel 12.

Although the apparatus 10 is illustrated with a ballpoint cartridge 57, the cartridge 57 may easily be replaced with a lead or porous-point type cartridge.

It will be understood that various changes in the details, materials, arrangements of the parts and operation conditions which have been herein described and illustrated in order to explain the nature of the invention may be made by those skilled in the art within the principles and scope of the invention.

Having thus set forth the nature of the invention, what is calimed is:

1. A combination writing instrument and information storage apparatus comprising:

an elongated barrel having first and second free ends and a first longitudinal open-ended chamber therein, a longitudinal slot being located in an outer surface of said barrel and extending into said first chamber;

an elongated cap element having a second longitudinal chamber therein, said cap element having a first free end and a second end;

an elongated tubular spindle dimensioned to be partially inserted through said second free end of said barrel and within said first longitudinal chamber, said spindle having a third longitudinal open-ended chamber therein, said spindle having a first free end and a second free end;

means for securing said first free end of said elongated tubular spindle to said second free end of said elongated cap element, said second and said third longitudinal chambers being partially coextensive;

rotatable securing means for rotatably securing said elongated tubular spindle partially within said barrel, said first and said second longitudinal chambers being partially coextensive;

cartridge-type writing means dimensioned to reside within said first, said second, and said third longitudinal chambers when said barrel is rotatably affixed to said spindle and said spindle is fixedly secured to said cap element;

means for extending and retracting said writing means through said first free end of said barrel; and a flexible sheet fixedly secured on one end thereof to the outer surface of said spindle and extending outwardly through said longitudinal slot, the rotation of said spindle in one direction about the longitudinal axis thereof retracting said flexible sheet within said first longitudinal chamber of said barrel, the rotation of said spindle in the other direction about the longitudinal axis thereof extending said flexible sheet out of said slot.

2. A combination writing instrument an information storage apparatus as claimed in claim 1, wherein said securing means comprises an externally threaded portion located adjacent said first free end of said elongated tubular spindle, and an internally threaded portion adjacent said second free end of said elongated cap element, said internally threaded portion dimensioned to capture and threadably retain therein said externally threaded portion.

3. A combination writing instrument and information storage apparatus as claimed in claim 1, wherein said rotatable securing means comprises an annular groove located in said outer surface of said elongated tubular spindle disposed within said first chamber of said barrel, and a pin frictionally disposed through an aperture located through said barrel, said annular groove disposed in a plane which is substantially normal to the longitudinal axis of said spindle, said groove dimensioned to capture and rotatably retain therein the free end of said pin extending into said first longitudinal chamber of said barrel.

4. A combination writing instrument and information storage apparatus as claimed in claim 1, wherein said cartridge-type writing means comprises a ball-point ink applicator and a housing therefore operably disposed on one end of an elongated hollow ink reservoir, ink filling said reservoir.

5. A combination writing instrument and information storage apparatus as claimed in claim 1, wherein said extending and retracting means comprises a rotatable inclined plane locking type mechanism disposed on said first free end of said cap element, said mechanism being accessible from outside said cap element, and a helical compression spring cooperating with said mechanism by urging said writing means toward said mechanism.

6. A combination writing instrument and information storage apparatus as claimed in claim 1, wherein said flexible sheet has informational inidicia disposed thereon.

7. A combination writing instrument and information storage apparatus as claimed in claim 6, wherein said informational indicia comprises a list of selected dates and corresponding holidays.

8. A combination writing instrument and information storage apparatus as claimed in claim 6, wherein said informational inidicia comprises a calendar.

9. A combination writing instrument and information storage apparatus as claimed in claim 1, wherein said slot is open-ended and extends through said second free end of said elongated barrel and the free edge adjacent thereto.

10. A combination writing instrument and information storage apparatus as claimed in claim 1, wherein said flexible sheet is fixedly secured to said spindle by a strip of adhesive type tape.

* * * * *